US010658773B2

(12) United States Patent
Zhang et al.

(10) Patent No.: US 10,658,773 B2
(45) Date of Patent: May 19, 2020

(54) DEFORMABLE TUBULAR CONTACT WITH RADIAL RECESS AROUND CONTACTING REGION

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Yun Zhang, Kunshan (CN); Xue-Yuan Xiao, Kunshan (CN); Zi-Qiang Zhu, Kunshan (CN)

(73) Assignees: FOXCONN (KUNSHAN) COMPUTER CONNECTOR Co., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/240,665

(22) Filed: Jan. 4, 2019

(65) Prior Publication Data

US 2019/0207333 A1 Jul. 4, 2019

(30) Foreign Application Priority Data

Jan. 4, 2018 (CN) ..... 2018 2 0013861 U

(51) Int. Cl.

| | |
|---|---|
| ***H01R 12/00*** | (2006.01) |
| ***H01R 12/58*** | (2011.01) |
| ***H01R 13/04*** | (2006.01) |
| ***H01R 12/52*** | (2011.01) |

(52) U.S. Cl.
CPC ..... *H01R 12/585* (2013.01); *H01R 12/52* (2013.01); *H01R 13/04* (2013.01)

(58) Field of Classification Search
CPC ..... H01R 12/585; H01R 12/52; H01R 13/04
USPC ..... 439/751, 943, 567
See application file for complete search history.

(56) References Cited

U.S. PATENT DOCUMENTS

| | | | | |
|---|---|---|---|---|
| 3,634,819 A * | 1/1972 | Evans | H01R 13/04 | 439/825 |
| 4,076,356 A | 2/1978 | Tamburro | | |
| 4,183,610 A | 1/1980 | Key | | |
| 4,381,134 A * | 4/1983 | Anselmo | H01R 12/585 | 439/444 |
| 4,526,429 A * | 7/1985 | Kirkman | H01R 12/58 | 439/751 |
| 4,735,575 A * | 4/1988 | Shaffer | H01R 12/585 | 439/751 |
| 4,783,899 A * | 11/1988 | Breese | H01L 23/40 | 29/525 |

(Continued)

*Primary Examiner* — Abdullah A Riyami
*Assistant Examiner* — Nelson R. Burgos-Guntin
(74) *Attorney, Agent, or Firm* — Wei Te Chung; Ming Chieh Chang

(57) ABSTRACT

An electrical contact of an electrical connector includes a mounting leg for being retained within a through hole of the printed circuit board wherein the mounting leg is tubular and is radially deformable to abut against an interior surface of the through hole. The mounting leg is radially thinned in thickness to confront the interior surface of the hole. The mounting leg is formed by rolling a metal plate with a C-shaped cross-section thereof. There are two thinned areas of the mounting leg, symmetrically located by two sides of the slit of the C-shaped cross-sectional configuration.

20 Claims, 7 Drawing Sheets

(56) References Cited

U.S. PATENT DOCUMENTS

| | | | | | |
|---|---|---|---|---|---|
| 4,802,862 | A * | 2/1989 | Seidler | H01R 12/585 | 439/83 |
| 4,867,691 | A * | 9/1989 | Eck | H01R 12/58 | 439/82 |
| 4,934,967 | A * | 6/1990 | Marks | H01R 13/111 | 439/751 |
| 5,055,055 | A * | 10/1991 | Bakker | H01R 13/6315 | 29/883 |
| 5,082,462 | A * | 1/1992 | Oswald, Jr. | H01R 13/111 | 439/380 |
| 5,083,927 | A * | 1/1992 | Herard | H01R 12/58 | 439/80 |
| 5,199,908 | A * | 4/1993 | Sucheski | H01R 12/585 | 439/751 |
| 6,210,181 | B1 * | 4/2001 | Tomita | H01R 12/58 | 439/78 |
| 6,315,581 | B1 * | 11/2001 | Yu | H01R 12/585 | 439/82 |
| 7,235,742 | B2 * | 6/2007 | Aochi | H01R 43/16 | 174/94 R |
| 7,850,460 | B2 * | 12/2010 | Weiland | G01R 1/06733 | 439/66 |

* cited by examiner

DEFORMABLE TUBULAR CONTACT WITH RADIAL RECESS AROUND CONTACTING REGION

FIELD OF THE DISCLOSURE

The invention is related to an electrical contact of an electrical connector for mounting to a printed circuit board.

DESCRIPTION OF RELATED ARTS

The compliant pin is popularly used in the connector field for mounting to a corresponding through hole in the printed circuit board. The most popular compliant pin is of a needle eye compressively retained in the corresponding through hole in the printed circuit board. Other compressive type contact may be of a C-shaped or M-shaped cross-sectional configuration deformably retained in the through hole of the printed circuit board. Anyhow, a contradictory concern exists between the less thickness for increasing the resiliency thereof and the more thickness for avoiding earlier yielding during mating.

A small dimensioned electrical contact having required resiliency and strength, is desired.

SUMMARY OF THE DISCLOSURE

An electrical contact of an electrical connector includes a mounting leg for being retained within a through hole of the printed circuit board wherein the mounting leg is tubular and is radially deformable to abut against an interior surface of the through hole. The mounting leg is radially thinned in thickness to confront the interior surface of the hole. The mounting leg is formed by rolling a metal plate with a C-shaped cross-section thereof. There are two thinned areas of the mounting leg, symmetrically located by two sides of the slit of the C-shaped cross-sectional configuration. Each thinned area forms a needle eye or fish eye recess from an exterior surface of the mounting leg wherein the long axis of the needle eye extends in an axial direction of the mounting leg. A shrunk type cone structure is formed at the bottom of the mounting leg wherein the thinned areas are partially located in the cone structure. The thickness of the thinned area is optimally more than one half of the original thickness of the mounting leg.

DETAILED DESCRIPTION OF THE PREFERRED EMBODIMENT

Figure 1:
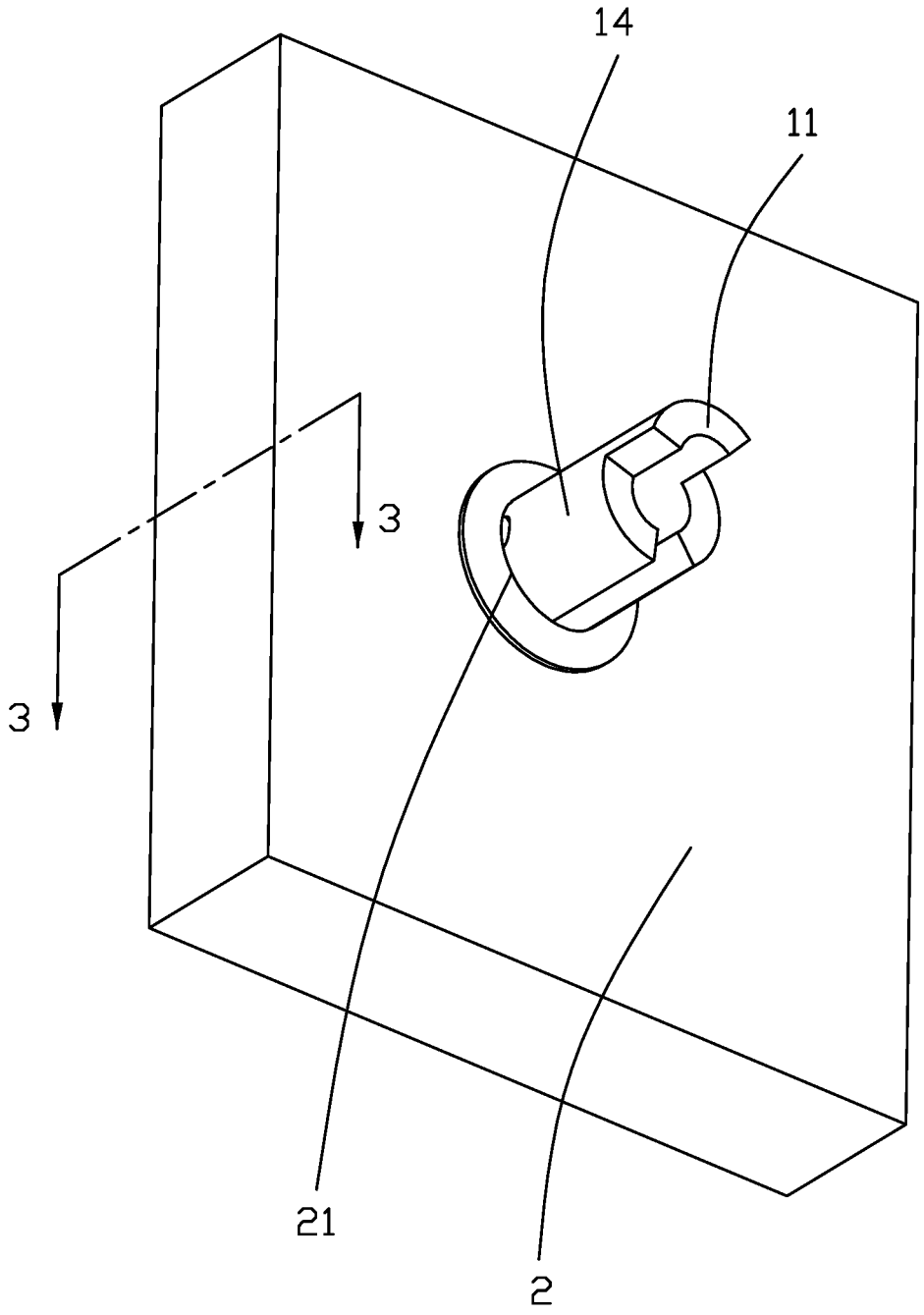
FIG. 1 is a downwardly perspective view of an electrical assembly having an electrical contact mounted to a printed circuit board according to the invention.

Referring to FIGS. 1-7, an electrical contact 100 for use within an electrical connector (not shown) has a tubular mounting leg 1 defining an axial direction thereof for mounting into a through hole 21 of a printed circuit board 2. The mounting leg 1 deformably abuts against an interior surface of the through hole 21. The upper tag 11 of the mounting leg 1 may be connected to another electrical part (not shown).

Figure 2:
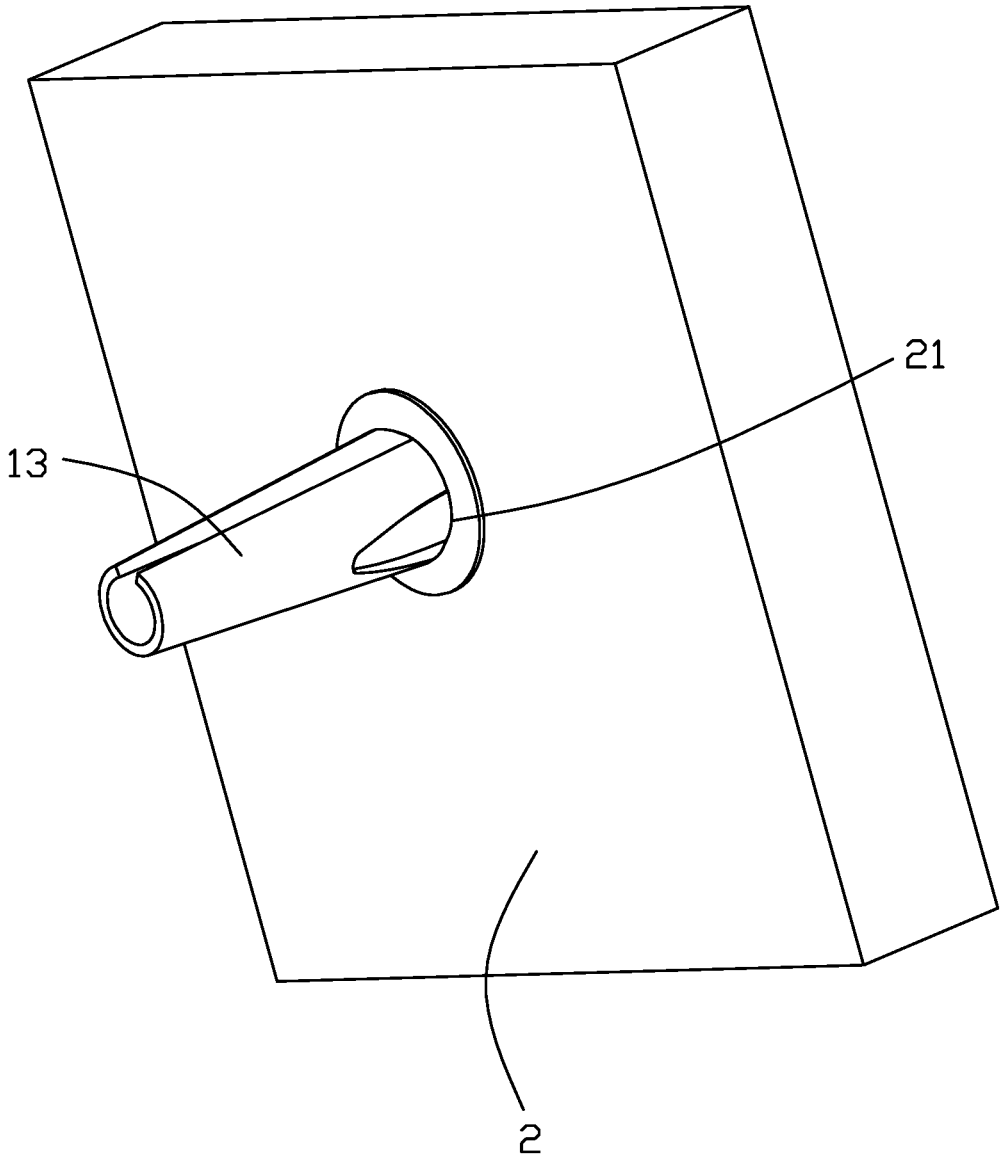
FIG. 2 is an upward perspective view of the connector assembly of FIG. 1.
Figure 3:
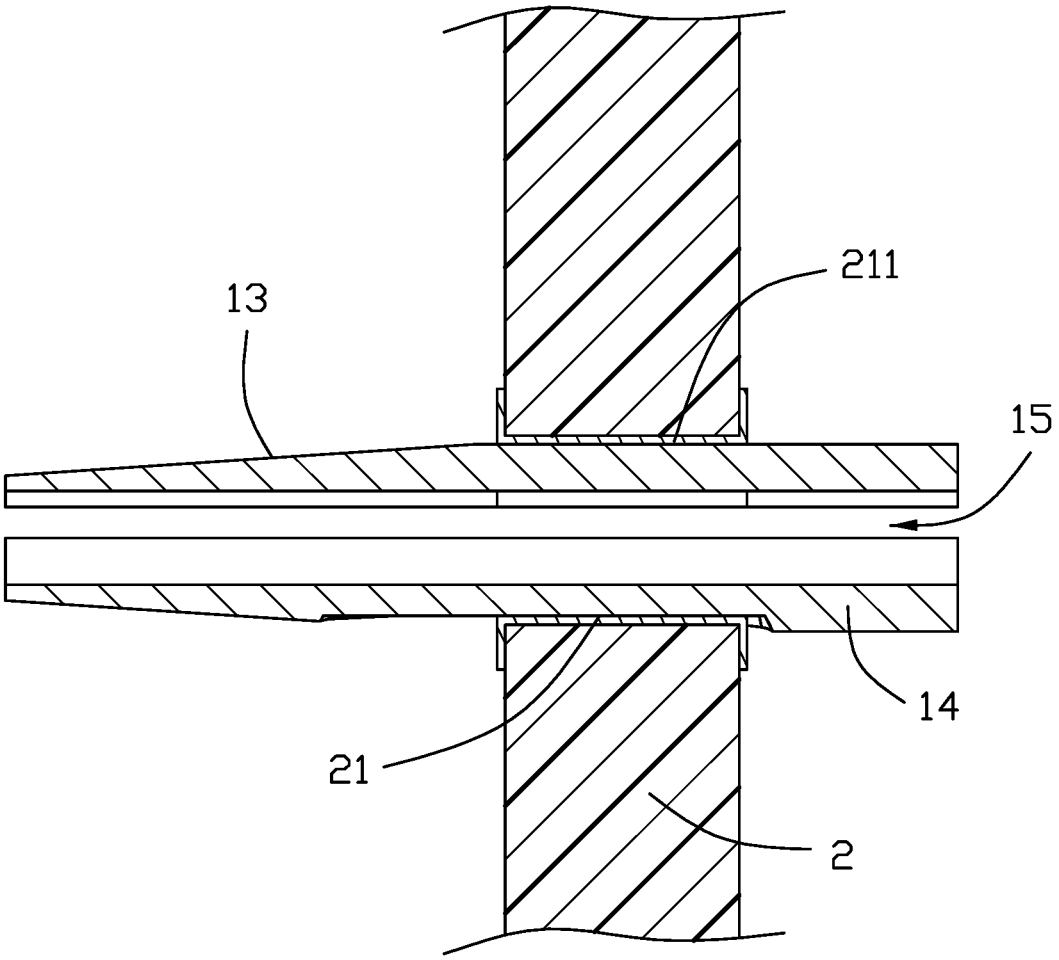
FIG. 3 is a cross-sectional view of the electrical connector assembly of FIG. 1.
Figure 4:
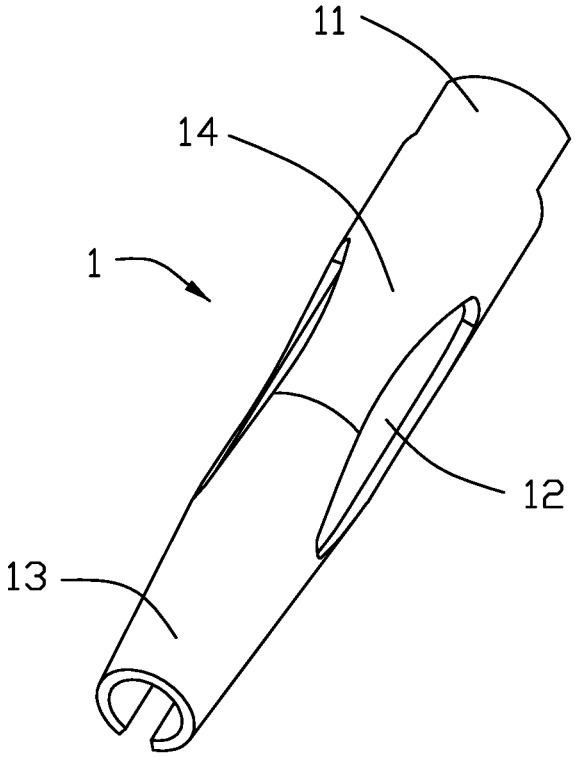
FIG. 4 is a perspective view of the electrical contact of the electrical assembly of FIG. 1.
Figure 5:
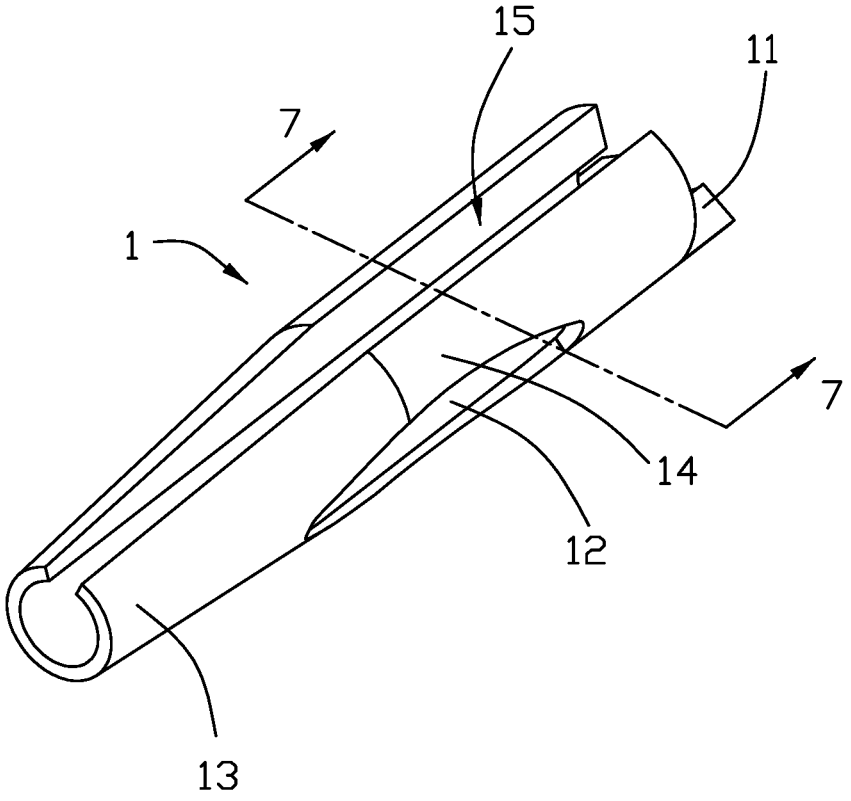
FIG. 5 is another perspective view of the electrical contact of the electrical assembly of FIG. 4 to show the slit thereof.
Figure 6:
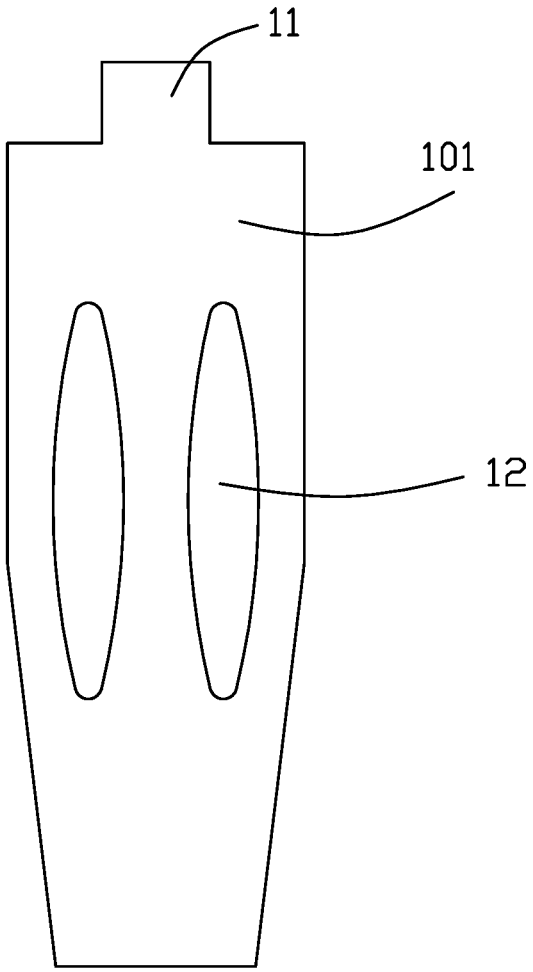
FIG. 6 is an elevational view of the extended electrical contact of the electrical assembly of FIG. 5.
Figure 7:
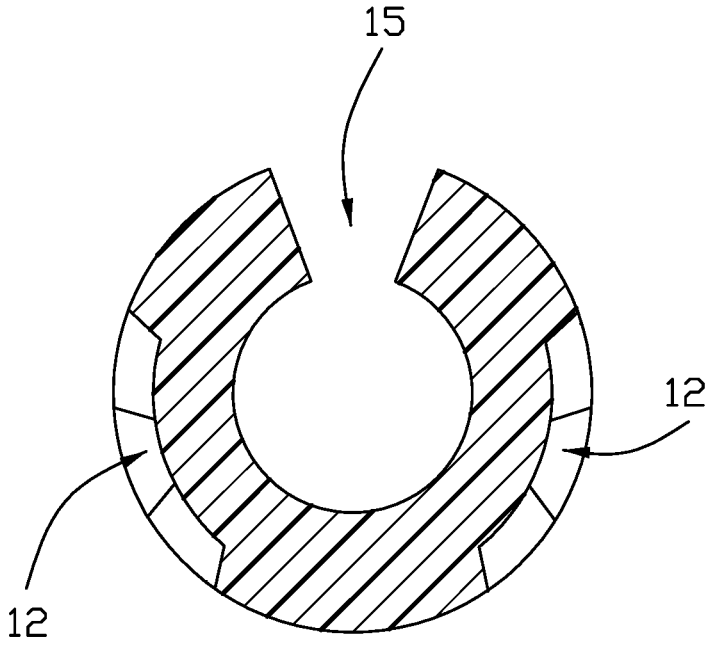
FIG. 7 is a cross-sectional view of the electrical contact of the electrical assembly of FIG. 1 to show the symmetrical arrangement of the thinned areas with regard to the slit of the contact.

The mounting leg 1 is made by rolling a sheet metal 101 with a slit 15 extending along an axial/vertical direction to form a C-shaped cross-sectional configuration. The mounting leg 1 includes in an exterior surface a pair of thinned areas 12 with a recess of a needle/fish eye configuration extending along the axial/vertical direction. The pair of thinned areas 12 are symmetrically arranged with regard to the slit for evenly dispersing the stress thereof during retained in the through hole 21. The mounting leg 1 has a cylindrical section 14 at the upper portion and a cone section 13 at the lower portion for guiding consideration. As shown in FIGS. 3-7, in the cylindrical section 14 and along the axial/vertical direction, a thickness of the recess essentially keeps constant. Anyhow, a portion of the cone section is received within the through hole 21 during mating. The diameter of the cylindrical section, in a relaxed manner, is essentially larger than a diameter of the through hole 21. After insertion into the through hole 21, the mounting leg 1 is inwardly radially deformed/compressed to comply with the diameter of the through hole so as to result in a resistance force against the interior surface of the through hole 21 for efficiently retaining the mounting leg 1 within the through hole 21. Understandably, the thinned area 12 and the slit 15 may provide inherent resiliency while the other portions may provide inherent rigidity. In other words, such an arrangement has the resiliency sector and the rigidity sector alternate arranged with each other circumferentially and symmetrically. Understandably, the shape, the number, the position and the depth of the recess of the thinned area may vary for complying with the mutual relation between the mounting leg and the printed circuit board. For example, the recess may be formed in the interior surface of the mounting leg 1, or the recess may extend through the mounting leg in the thickness direction to form a through opening. In addition, the cross-sectional of the mounting leg 1 may be of the M-shaped configuration or the N-shaped configuration other than the C-shaped configuration. Notably, as shown in FIGS. 1-3, the dimension of the thinned area 12 along the axial/vertical direction is larger than a thickness of the printed circuit board 2 so that when mounting into the through hole 21 of the printed circuit board 2, the through hole 21 of the printed circuit board 2 retains the cylindrical section 14 therein while exposing the cone section 13. As shown in FIG. 3, a metallic rim 211 is formed on an interior surface of the through hole 21 so that the thinned area 12 is intimately and directly engaged with the rim 211 in the through hole 21 without any external securing component therebetween.

While a preferred embodiment according to the present disclosure has been shown and described, equivalent modifications and changes known to persons skilled in the art according to the spirit of the present disclosure are considered within the scope of the present disclosure as described in the appended claims.

What is claimed is:

1. An electrical contact for mounting into a through hole in a printed circuit board, comprising:

a radially deformable tubular mounting leg formed by rolling shell metal with a slit extending along an axial direction of the mounting leg, said mounting leg including an upper cylindrical section and a lower cone section, and at least one thinned area formed in the mounting leg and recessed in a thickness direction thereof; wherein the thinned area extends along the axial direction, and a thickness of the thinned area in the upper cylindrical section keeps constant.

2. The electrical contact as claimed in claim 1, wherein said thinned area forms a recess in an exterior surface of the mounting leg.

3. The electrical contact as claimed in claim 2, wherein said recess is of a needle eye configuration.

4. The electrical contact as claimed in claim 3, wherein said needle eye configuration occupies both the cylindrical section and the cone section.

5. The electrical contact as claimed in claim 4, wherein a long axis of the needle eye configuration extends along the axial direction.

6. The electrical contact as claimed in claim 5, wherein said mounting leg defines a C-shaped cross-sectional configuration.

7. The electrical contact as claimed in claim 6, wherein the thinned area is dimensioned more than one half a thickness of other portions of the mounting leg.

8. The electrical contact as claimed in claim 1, further including another thinned area same with said thin area, and both said thinned areas are located symmetrically with regard to the slit.

9. An electrical assembly comprising:

a printed circuit board forming a through hole in a vertical direction;

an electrical contact including a radially deformable tubular mounting leg formed by rolling sheet metal with a slit extending along an axial direction parallel to the vertical direction, said mounting leg including an upper cylindrical section and a lower cone section; and at least one thinned area formed in at least the cylindrical section of the mounting leg and recessed in a thickness direction thereof; wherein during mating, the cylindrical section is received in the through hole in a compressed manner while the cone section is exposed outside of the through hole; wherein said thinned area extends along the axial direction and continuously occupies both the upper cylindrical section and the lower cone section.

10. The electrical assembly as claimed in claim 9, wherein the thinned area forms a recess in an exterior surface of the mounting leg.

11. The electrical assembly as claimed in claim 10, wherein said recess is of a needle eye configuration, and a long axis of the needle eye configuration extends along the axial direction.

12. The electrical assembly as claimed in claim 11, wherein the thinned area is dimensioned more than one half a thickness of other portions of the mounting leg.

13. The electrical assembly as claimed in claim 9, further including another thinned area same with said thin area, and both said thinned areas are located symmetrically with regard to the slit.

14. An electrical assembly comprising:

a printed circuit board forming a through hole in a vertical direction with a metallic rim on an interior surface of the through hole;

an electrical contact including a radially deformable tubular mounting leg formed by rolling sheet metal with a slit extending along an axial direction parallel to the vertical direction, said mounting leg including an upper cylindrical section and a lower cone section; and at least a thinned area with one recess formed in at least the cylindrical section of the mounting leg and recessed in a thickness direction with a thickness thereof; wherein during mating, the cylindrical section is received in the through hole in a compressed manner while the cone section is exposed outside of the through hole: wherein the thinned area is intimately and directly engaged with the rim in the through hole without any external securing component therebetween.

15. The electrical assembly as claimed in claim 14, wherein a depth of said recess in said thickness direction is smaller than a thickness of the mounting leg.

16. The electrical assembly as claimed in claim 15, further including another recess same with said recess, and both said recesses are symmetrically arranged with regard to the slit.

17. The electrical assembly as claimed in claim 15, wherein said recess extends further into the cone section along the axial direction.

18. The electrical assembly as claimed in claim 17, wherein the recess in the upper cylindrical section is hidden in the through hole while the recess in the lower cone section is radially exposed to an exterior.

19. The electrical assembly as claimed in claim 14, wherein the thickness of the thinned area keeps constant in the upper cylindrical section.

20. The electrical assembly as claimed in claim 9, wherein the thickness of the thinned area keeps constant in the upper cylindrical section.

* * * * *